US009207648B2

(12) United States Patent
Liao et al.

(10) Patent No.: US 9,207,648 B2
(45) Date of Patent: Dec. 8, 2015

(54) WATCH HAVING MICROPHONE

(71) Applicant: HON HAI PRECISION INDUSTRY CO., LTD., New Taipei (TW)

(72) Inventors: Kuang-Yao Liao, New Taipei (TW); Shiang-Hua Lin, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 271 days.

(21) Appl. No.: 13/869,030

(22) Filed: Apr. 24, 2013

(65) Prior Publication Data

US 2014/0177395 A1 Jun. 26, 2014

(30) Foreign Application Priority Data

Dec. 21, 2012 (TW) ..... 101148902 A

(51) Int. Cl.
*H04R 3/00* (2006.01)
*G04G 21/06* (2010.01)

(52) U.S. Cl.
CPC ..... *G04G 21/06* (2013.01)

(58) Field of Classification Search
USPC ..... 381/2, 26, 77, 79, 122, 111, 120, 355, 381/365; 368/10, 281, 276; 307/104; 320/108; 455/563, 41.2, 556.1
See application file for complete search history.

(56) References Cited

U.S. PATENT DOCUMENTS

| | | | | |
|---|---|---|---|---|
| 6,091,965 | A * | 7/2000 | Voroba et al. | 455/570 |
| 6,912,287 | B1 * | 6/2005 | Fukumoto et al. | 381/151 |
| 2005/0265125 | A1 * | 12/2005 | Yoshida et al. | 368/10 |
| 2006/0114751 | A1 * | 6/2006 | Ferri et al. | 368/281 |
| 2009/0069045 | A1 * | 3/2009 | Cheng | 455/556.1 |
| 2010/0111333 | A1 * | 5/2010 | Dinnissen et al. | 381/122 |
| 2012/0122519 | A1 * | 5/2012 | Jochheim | 455/556.1 |
| 2012/0299389 | A1 * | 11/2012 | Lee et al. | 307/104 |
| 2013/0114833 | A1 * | 5/2013 | Thomas et al. | 381/122 |

* cited by examiner

*Primary Examiner* — Vivian Chin
*Assistant Examiner* — Friedrich W Fahnert
(74) *Attorney, Agent, or Firm* — Novak Druce Connolly Bove + Quigg LLP

(57) ABSTRACT

A watch includes a sound input body and a main body. The main body include an interface unit, a first electromagnetic coil unit, a signal processing unit, and a control unit. The sound input body includes a microphone and a second electromagnetic coil unit. The second electromagnetic coil unit generates inducted electromagnetic filed in response to an electric signal generated by the microphone. The first electromagnetic coil unit coupling the second electromagnetic coil unit generates electric signal in response to the electromagnetic field. The signal processing unit filters algorithm of the electric signal. The control unit recognizes the electric signal amplified by the signal amplification unit to execute corresponding function.

1 Claim, 2 Drawing Sheets

WATCH HAVING MICROPHONE

CROSS-REFERENCES TO RELATED APPLICATIONS

Related subject matter is disclosed in co-pending U.S. patents application with Ser. No. 13/869,894 and a title of WATCH CAPABLE OF PLAYING SOUND, and Ser. No. 13/869,898 and a title of WATCH HAVING MICROPHONE, which have the same assignees as the current application and were concurrently filed.

BACKGROUND

1. Technical Field

The present disclosure relates to watches and, particularly, to a watch having a microphone.

2. Description of the Related Art

Smart watches are employed for events reminder and time reminder besides displaying time and data. Users input events via microphone employed by the smart watch. Therefore, the microphone is mounted in the watch which results in an additional circuit board corresponding thereto being mounted and thickens the watch. Furthermore, the circuit board corresponding to the microphone is powered by a battery of the watch which results in shortening service life of the battery of the watch.

Therefore, there is room for improvement within the art.

BRIEF DESCRIPTION OF THE DRAWINGS

The components in the drawings are not necessarily drawn to scale, the emphasis instead being placed upon clearly illustrating the principles of a lamp tube switch circuit. Moreover, in the drawings, like reference numerals designate corresponding parts throughout the several views.

DETAILED DESCRIPTION

Figure 1:
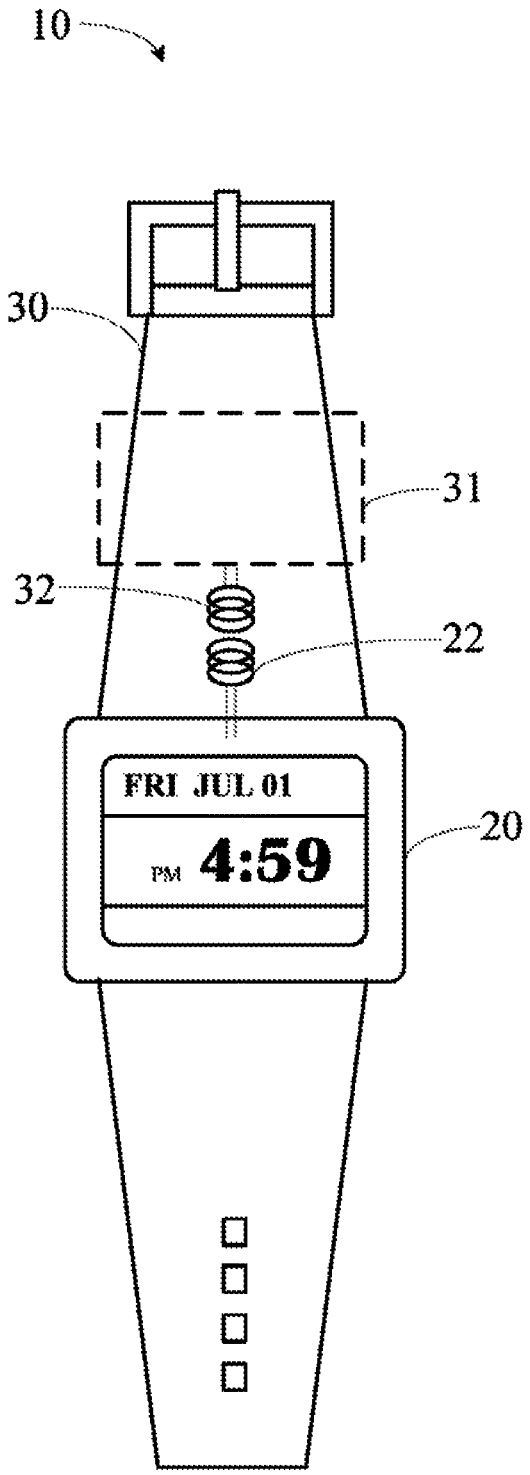
FIG. 1 is a schematic view of a watch having a microphone in accordance with an exemplary embodiment.

Referring to FIG. 1, a watch 10 includes a main body 20 and a sound input body 30. In the embodiment, the watch 10 further includes a strap configured to tie the main body 20 to a wrist of a user, and the sound input body 30 is mounted on the strap. In an alternative embodiment, the sound input body 30 is mounted on the main body 20. The main body 20 includes a display screen for displaying time and data.

Figure 2:
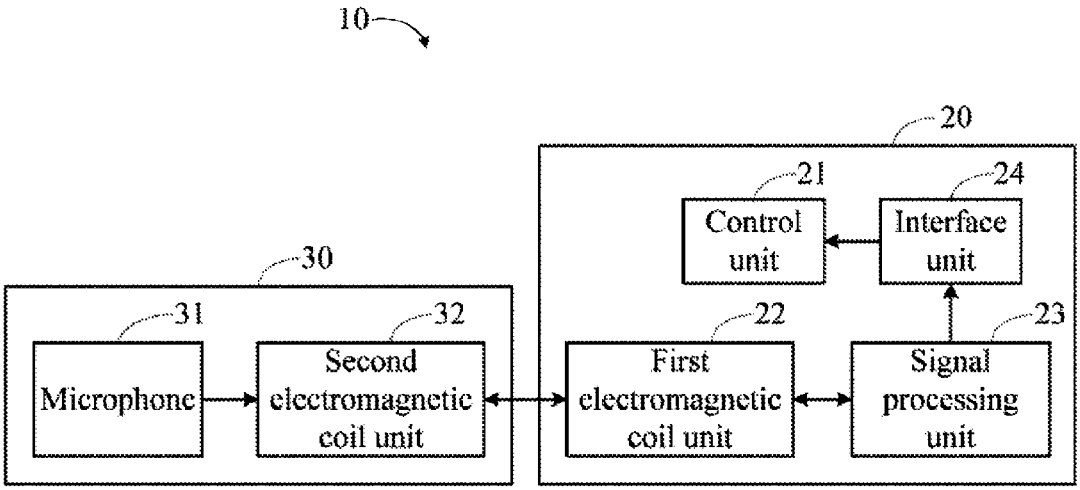
FIG. 2 is a diagram of the watch of FIG. 1 in accordance with an exemplary embodiment.

Referring to FIG. 2, the main body 20 includes a control unit 21, a first electromagnetic coil unit 22, a signal processing unit 23, and an interface unit 24. The sound input body 30 includes a microphone 31 and a second electromagnetic coil unit 32. The second electromagnetic coil unit 32 is connected to the microphone 31. The first electromagnetic coil unit 22 is mounted on the main body 20 and coupling the second electromagnetic coil unit 32. The control unit 21 is connected to the signal processing unit 23 via the interface unit 24. In the embodiment, the first electromagnetic coil unit 22 is mounted on a frame of the main body 20.

The microphone 31 is configured to receive a sound signal input by a user and convert the sound signal into an electric signal. The second electromagnetic coil unit 32 generates an inducted electromagnetic field in response to the electric signal transmitted by the microphone 31. In the embodiment, the microphone 31 is mounted on a surface of the strap.

The generation of the electromagnetic field results in the generation of electric signal in the first electromagnetic coil unit 22. The signal processing unit 23 is configured to filter noise in the electric signal generated by the first electromagnetic coil unit 22. The control unit 21 recognizes the electric signal processed by the signal processing unit 23 via the interface unit 24 to execute corresponding function.

It is understood that the present disclosure may be embodied in other forms without departing from the spirit thereof. Thus, the present examples and embodiments are to be considered in all respects as illustrative and not restrictive, and the disclosure is not to be limited to the details given herein.

What is claimed is:

1. A watch comprising:

a main body and a strap configured to tie the main body to user's wrist; and a sound input body mounted on the strap, the sound input body comprising:

a microphone configured to detect and receive sound and convert the sound into an electric signal; and a first electromagnetic coil unit connected to the microphone, the first electromagnetic coil unit configured to generate an induced electromagnetic field in response to the electric signal generated by the microphone;

the main body comprising:

an interface unit;

a second electromagnetic coil unit coupled with the first electromagnetic coil unit, and configured to generate an induced electromagnetic field in response to the generation of the electromagnetic field by the first electromagnetic coil unit, and receive the electric signal of the sound relayed from the first electromagnetic coil unit;

a signal processing unit coupled to the second electromagnetic coil unit, and configured to filter noise in the electric signal of the sound received by the second electromagnetic coil unit; and a control unit coupled to the signal processing unit via the interface unit, and configured to recognize the electric signal processed by the signal processing unit and execute corresponding function.

* * * * *